US005431357A

United States Patent [19]

Rüegg

[11] Patent Number: 5,431,357

[45] Date of Patent: Jul. 11, 1995

[54] PROCESS AND APPARATUS FOR WINDING UP A CONTINUOUSLY FED WEB OF MATERIAL ONTO A NUMBER OF WINDING CORES

[76] Inventor: Anton Rüegg, St. Gallerstrasse 34, 8716 Schmerikon, Switzerland

[21] Appl. No.: 142,141

[22] Filed: Oct. 28, 1993

[30] Foreign Application Priority Data

Oct. 28, 1992 [CH] Switzerland ..... 03346/92

[51] Int. Cl.[6] ..... B65H 19/28

[52] U.S. Cl. ..... 242/541.1; 242/526

[58] Field of Search ..... 242/56 R, 65, 66, 67.1 R, 242/541.1, 526

[56] References Cited

U.S. PATENT DOCUMENTS

| | | | |
|---|---|---|---|
| 3,857,524 | 12/1974 | Melead et al. | 242/56 R |
| 3,889,892 | 6/1975 | Melead | 242/56 R |
| 4,191,341 | 3/1980 | Looser | 242/56 A |
| 4,204,650 | 5/1980 | Mengel | 242/56 R |
| 4,546,930 | 10/1985 | Rohde et al. | 242/56 R |
| 4,552,317 | 11/1985 | Halter | 242/65 |
| 4,696,004 | 9/1987 | Grossmann et al. | 242/56 R |
| 5,184,787 | 2/1993 | Holzinger et al. | 242/65 |
| 5,192,034 | 3/1993 | Beisswanger | 242/65 |
| 5,249,758 | 10/1993 | Müller et al. | 242/65 |
| 5,251,835 | 10/1993 | Kyytsünen | 242/65 |
| 5,261,620 | 11/1993 | Holzinger et al. | 242/65 |

FOREIGN PATENT DOCUMENTS

| | | |
|---|---|---|
| 2010072 | 10/1976 | Germany . |
| 3212960A1 | 10/1983 | Germany . |

*Primary Examiner*—John P. Darling
*Attorney, Agent, or Firm*—Oliff & Berridge

[57] ABSTRACT

A winding apparatus winds up a continuously fed web of material onto a number of winding cores. Shortly before removing a finished roll from a main winding location, a drive mechanism is coupled onto a winding core, located in a waiting position. The drive mechanism drives the winding core before the core is set down on a web of material running over a winding drum. The winding core remains driven until the winding core with already wound-up web of material has been transferred at the main winding location onto bearing arms. Due to the continuing driving of the winding core during a change of rolls, qualitatively high-grade rolls can be wound with a wide variety of webs of material.

14 Claims, 11 Drawing Sheets

PROCESS AND APPARATUS FOR WINDING UP A CONTINUOUSLY FED WEB OF MATERIAL ONTO A NUMBER OF WINDING CORES

BACKGROUND OF THE INVENTION

1. Field of the Invention

The invention relates to a process and an apparatus for winding up a continuously fed web of material onto a number of winding cores.

2. Background of the Invention

There are known winding apparatus such as U.S. Pat. No. 4,191,341, CH-A-666,014 and U.S. Pat. No. 4,552,317. However, there are problems associated with such apparatus. In particular, these apparatus are not capable of winding up diverse materials to form qualitatively high-grade rolls.

SUMMARY OF THE INVENTION

It is an object of the invention to provide a process and apparatus able to wind up a continuously fed web of material onto a number of winding cores obtaining rolls of very high quality even using difficult material.

This and other objects are achieved by a process for winding up a continuously fed web of material onto a number of winding cores, comprising the following steps:

a) a web of material is passed over a rotatably mounted winding drum at a predetermined speed and wound up at a main winding location onto winding cores along a web path to form rolls of a specified size;

b) shortly before a first roll forming at the main winding location reaches its specified size, a drive mechanism is coupled onto an empty winding core, located in a waiting position, and drives the winding core at a circumferential speed corresponding to the predetermined speed of the web of material;

c) the still driven empty winding core is then moved to an auxiliary winding location arranged ahead of the main winding location in the direction of movement of the web of material along the web path, and at this auxiliary winding location is brought into contact with the web of material, running over the winding drum;

d) the web of material is severed between the auxiliary winding location and the main winding location and, at the auxiliary winding location is wound up onto the driven winding core forming a second roll, while the finished first roll is removed from the main winding location; and e) subsequently, the winding core is moved from the auxiliary winding location to the main winding location and the second roll is wound into finished form. An apparatus for achieving this process is also provided and comprises:

a) a rotatably mounted winding drum, over which a web of material is passed along a web path;

b) a first bearing arrangement, arranged in the web path after the winding drum, for the releasable bearing of a winding core, onto which the web of material is wound up at a main winding location to form a first roll of a specified size;

c) a feed device for feeding an empty winding core from a waiting position to an auxiliary winding location arranged ahead of the first bearing arrangement along the web path, and in which the empty winding core is positionable into contact with the web of material running over the winding drum;

d) a second bearing arrangement for receiving and rotatably mounting the empty winding core fed by the feed device, the arrangement being positionable between a take-over position and a transfer position, the transfer position allowing transfer of the winding core to the first bearing arrangement;

e) a separating device, arranged between the auxiliary winding location and the main winding location, for separating the web of material; and f) a drive mechanism, switchable between on and off states, for rotatably driving the empty winding core, the mechanism being coupled onto the empty winding core when the core is located in the waiting position, and is uncoupled from the core after transfer of the winding core from the second bearing arrangement to the first bearing arrangement.

Due to the fact-that, in a change of rolls, when taking away a finished roll from the winding apparatus, the empty winding cores are driven before setting down on the web of material running over the winding drum and also remain driven during the subsequent winding up of the web of material, webs of material having a wide variety of material characteristics can be wound up to form qualitatively high-grade rolls.

BRIEF DESCRIPTION OF THE DRAWINGS

An exemplary embodiment of the subject of the invention is explained in more detail below with reference to the drawings, in which purely diagrammatically.

DETAILED DESCRIPTION OF THE PREFERRED EMBODIMENTS

The construction of a preferred embodiment of a winding apparatus according to the invention is described below with reference to FIGS. 1–5.

Figure 1:
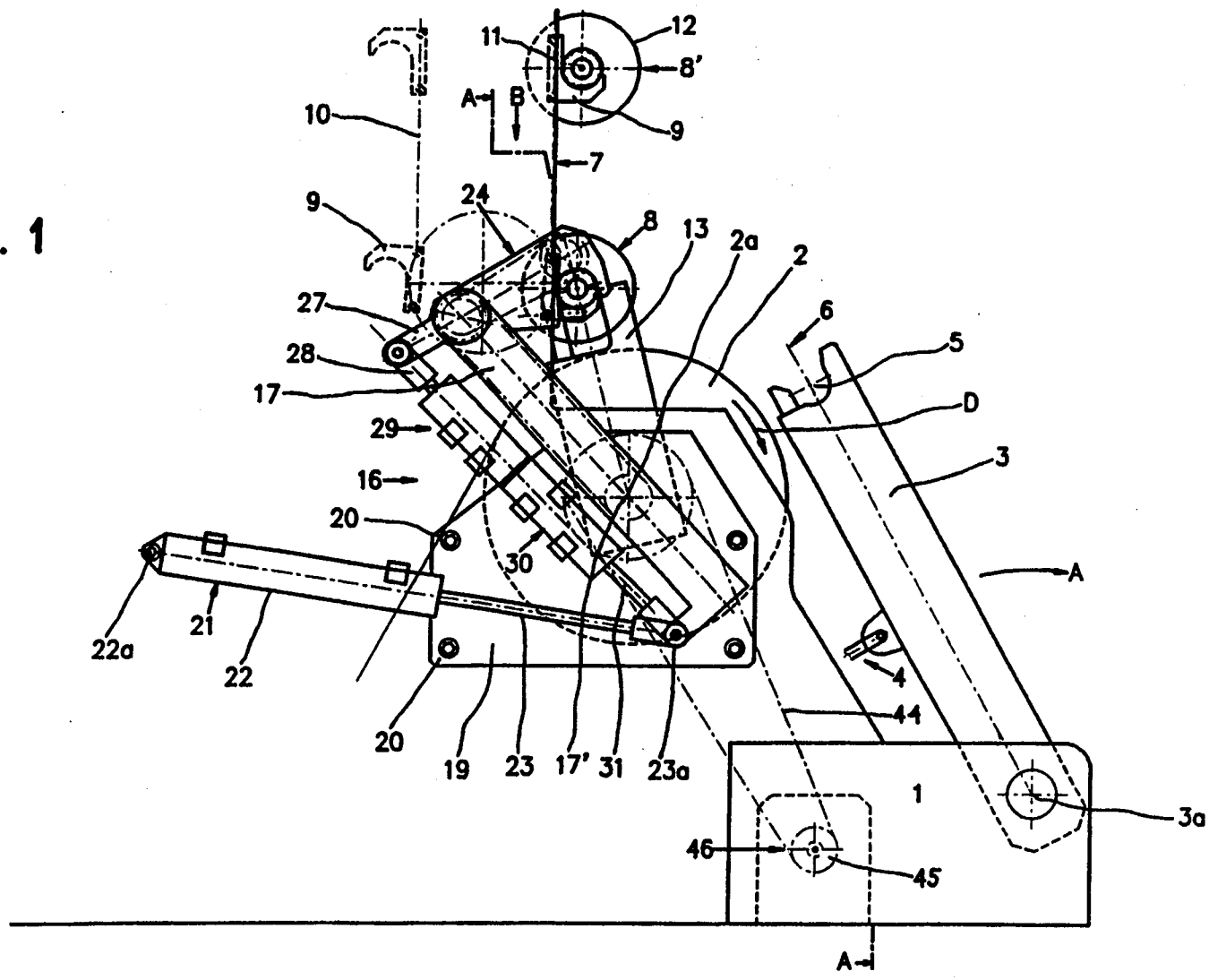
FIG. 1 shows a winding apparatus of the type according to the invention in side view.

A winding drum 2 is rotatably mounted in a machine frame 1, which is only partially represented in FIG. 1. This winding drum is driven in a way not shown in any more detail but known per se in the direction of the arrow D about its axis 2*a*. From this direction of rotation D of the winding drum 2, the drum is followed by a pair of bearing arms 3, of which only one bearing arms is visible. Each bearing arm 3 is mounted in the frame 1 in such a way that it can swivel about an axis 3*a* in the direction of the arrow A. On the bearing arms 3 there acts a swivel drive 4, which is only indicated in FIG. 1 and has a fluid-actuated piston-cylinder unit (not shown), as is known per se, for example, from U.S. Pat. No. 4,191,341 and CH-A-666,014 (or the corresponding U.S. Pat. No. 4,552,317). Each bearing arm 3 has at its free end a bearing 5 for receiving the winding shaft of winding cores. In the position of the bearing arms 3 shown in FIG. 1, the arms define with their free end a main winding location 6.

Above the winding drum 2 there is a feed 7 for empty winding cores 8. This feed 7 has holders 9, which are fastened on two chains 10, which can be driven in a circulating manner in the direction of the arrow B and of which only one chain is visible in FIG. 1. The winding cores 8 rest with the ends of their winding shaft 11 on these holders 9. Pushed onto the winding shaft 11 is a sleeve 12 (or else a plurality of sleeves).

Arranged on the frame 1 on both sides of the winding drum 2 are pivot arms 13, of which likewise only one pivot arm is visible in FIG. 1. These pivot arms are mounted in such a way that they can pivot about the axis of rotation 2*a* of the winding drum 2. The pivot arms 13 are swivelled about the axis of rotation 2*a* by means of a drive (not shown) in a way still to be described.

To this extent, the winding apparatus shown corresponds in principle to known winding apparatuses, such as are known, for example, from U.S. Pat. No. 4,191,341.

Figure 2:
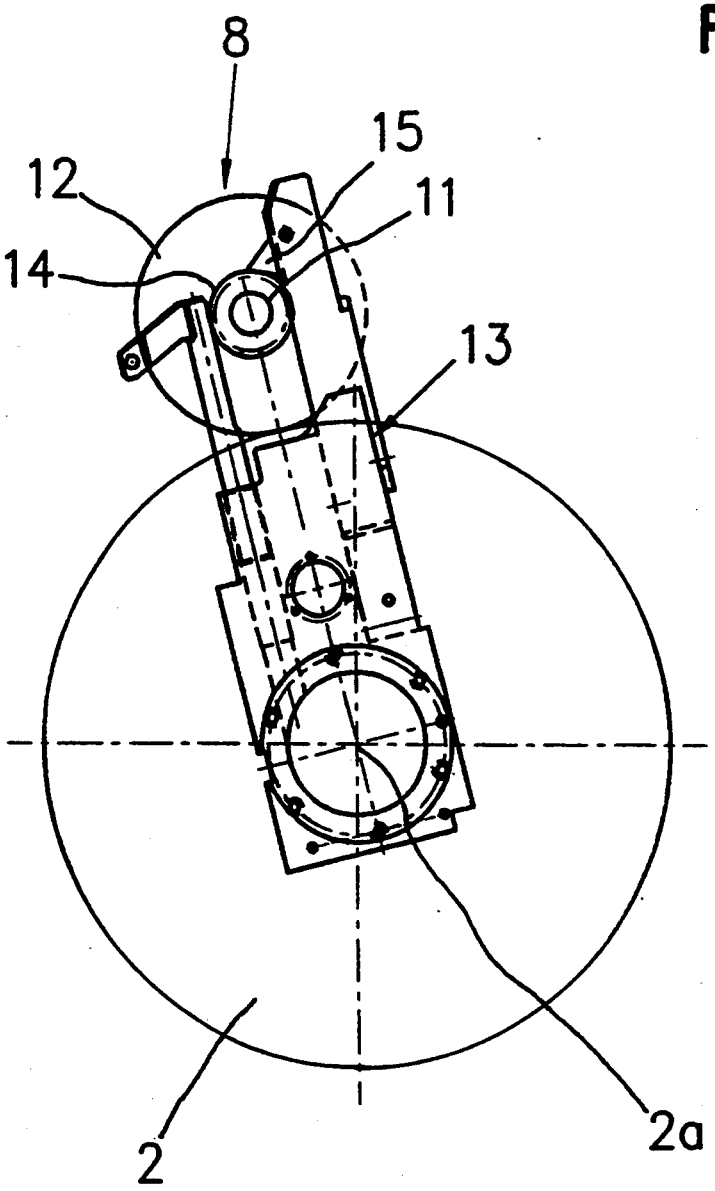
FIG. 2 shows a part of the apparatus according to FIG. 1 in side view.

In FIG. 2, the design of the pivot arms 13, which serve for respectively receiving a winding core 8, is shown more clearly. Each pivot arm 13 has at its free end a receiving opening 14, which serves for receiving the winding shaft 11 of a winding core 8. Into this receiving opening 14 there protrudes a hold-down device 15, which can be pushed back against spring force and serves to hold the winding shaft 11 in its position in the receiving opening 14 and consequently to prevent the winding shaft 11 from being able to shift during its rotation in the receiving opening 14.

Figure 3:
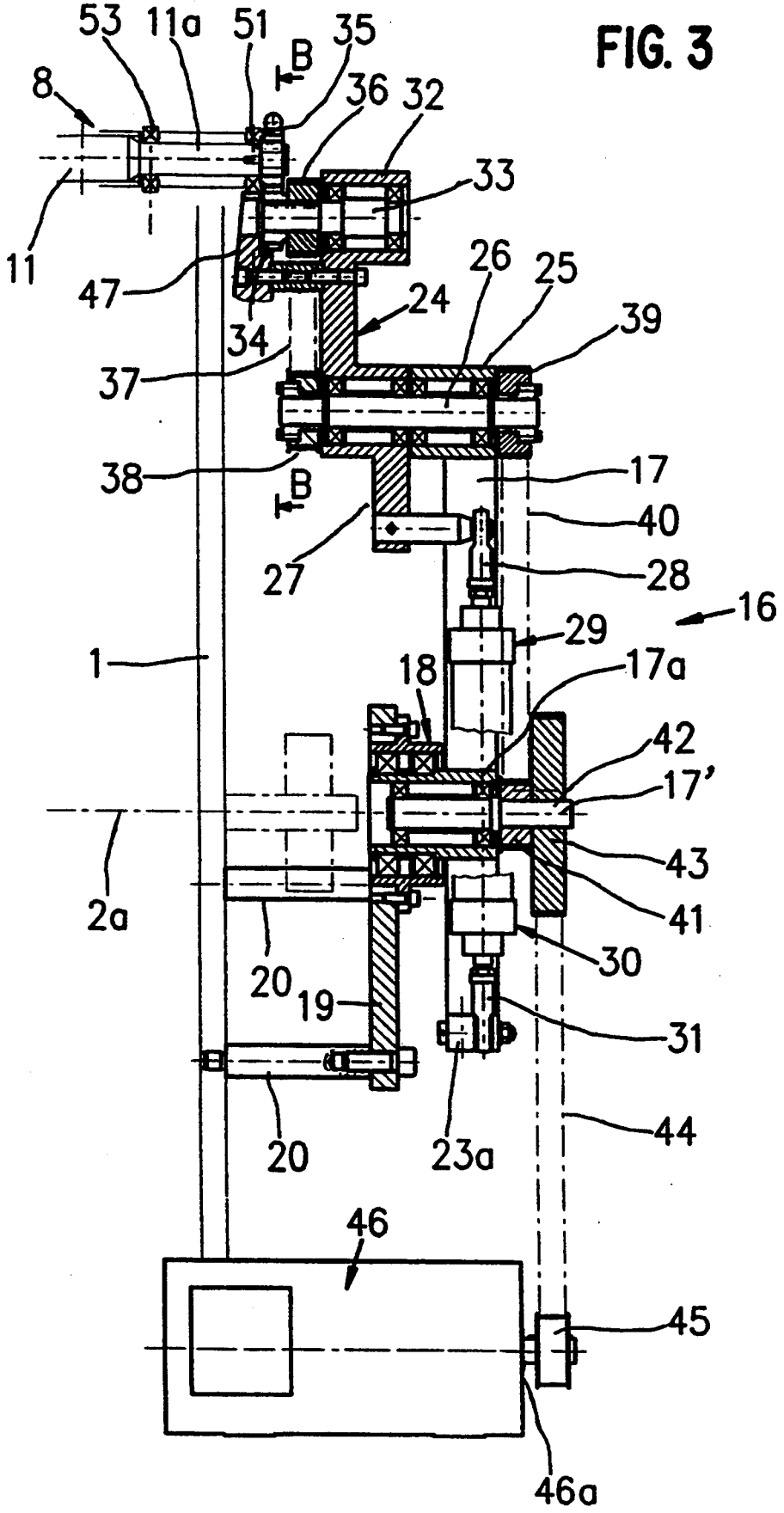
FIG. 3 shows a section along the line A—A in FIG. 1.
Figure 4:
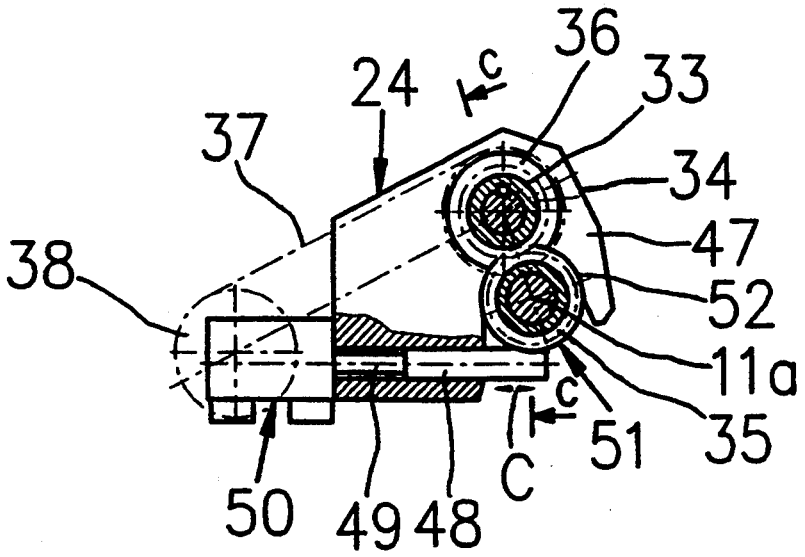
FIG. 4 shows a section along the line B—B in FIG. 3.
Figure 5:
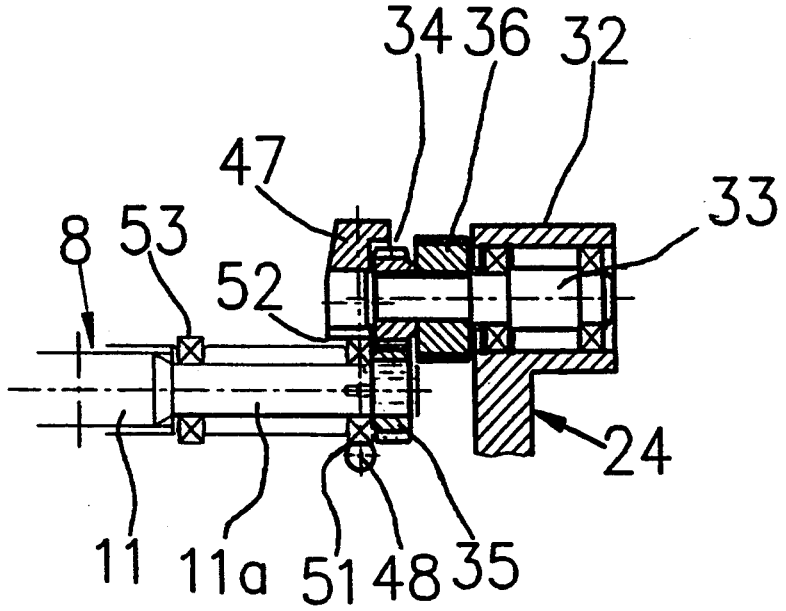
FIG. 5 shows a section along the line C—C in FIG. 4.

For driving the winding cores 8, there is a drive mechanism, denoted in general by 16. More detailed construction of this mechanism is shown in FIGS. 3–5. This drive mechanism 16 has a swivel arm 17, which is pivotally mounted in a holding plate 19 by means of a projecting hollow shaft 17*a* by a bearing 18 (FIG. 3). This holding plate 19 is fastened on the basic frame 1 by means of fastening elements 20. In this case, the arrangement is set out such that the swivel axis 171 of the swivel arm 17 aligns with the axis of rotation 2*a* of the winding drum 2. At the end of one part of the two-armed swivel arm 17 there engages a drive 21, as best shown in FIG. 1, which is designed as a pneumatic piston-cylinder unit. A cylinder 22 of this drive 21 is fastened at its end 22*a* on the basic frame 1 in such a way that it can swivel. A piston rod 23 of the drive 21 is connected at its end 23*a* in an articulated manner to the swivel arm 17.

At the end of the other part of the swivel arm 17, a coupling arm 24 is arranged in such a way that it can swivel. For the mounting of this coupling arm 24, there is provided on the swivel arm 17 a bearing part 25 (FIG. 3), in which a shaft 26 is rotatably arranged. The coupling arm is mounted pivotally on this shaft 26. The coupling arm 24 has an extension part 27, on which the piston rod 28 of a pneumatic piston-cylinder unit 29 acts. A further pneumatic piston-cylinder unit 30 is connected to this piston-cylinder unit 29. For this purpose, the cylinders of these two piston-cylinder units 29, 30 are securely interconnected by their bottoms. The piston rod 31 of the second piston-cylinder unit 30 acts alongside the end 23*a* of the piston rod 23 of the drive 21 on the one end of the swivel arm 17, as shown in FIGS. 1 and 3.

As shown in FIGS. 3 and 5, a bearing part 32 is arranged on the coupling arm 24 at its end opposite the extension part 27. Inside this bearing part 32 there is rotatably mounted a shaft 33, onto which a gearwheel 34 is keyed. This gearwheel 34 serves the purpose of engaging with a further gearwheel 35, seated on the end 11*a* of the winding shafts 11. In FIGS. 3–5, the coupling arm 24 is shown in its coupled position, in which the gearwheels 34 and 35 are in engagement with each other.

For driving the shaft 33, and consequently the gearwheel 34, arranged on this shaft 33 is a belt pulley 36, which is connected by a belt 37 to a second belt pulley 38, which is fastened at one end of the shaft 26 on the latter. At the opposite end of the shaft 26 there is attached a further belt pulley 39, connected by a belt 40 to a belt pulley 41. The pulley 41 is seated on a shaft 42 mounted rotatably inside the hollow shaft 17*a* of the swivel arm 17. Arranged on this shaft 42 is a second belt pulley 43 connected by a belt 44 to a belt pulley 45, which is seated on the shaft 46*a* of a drive motor 46. This motor 46 is fastened on the frame 1, as shown in FIGS. 1 and 3.

At its end having the bearing part 32, the coupling arm 24 bears a holding part 47, in which a clamping bolt 48 is mounted displaceably in the direction of the arrow C (FIG. 4). This clamping bolt 48 is arranged on a piston rod 49 of a pneumatic piston cylinder unit 50, which is fastened on holding part 47. With coupling arm 24 located in its coupling position, the extended bolt 48 serves the purpose of securely clamping the outer ring of a ball bearing or roller bearing 51, which is fitted on the end 11*a* of the winding shaft 11 (see in particular FIGS. 4 and 5). In the holding part 47 there is formed a cylindrical countersurface 52 (FIG. 4) opposite the clamping bolt 48 and against which the outer ring of the ball bearing or roller bearing 51 comes to bear, as FIGS. 4 and 5 reveal. With clamping bolt 48 extended, the outer ring of this ball bearing or roller bearing 51 is consequently securely clamped between clamping bolt 48 and the countersurface 52.

On the end 11*a* of the winding shaft 11 there is seated a further ball bearing or roller bearing 53 (FIG. 5), which comes to lie in the receiving opening 14 of pivot arm 13.

The operating principle of the winding apparatus is explained in more detail with reference to FIGS. 6–12, the reference symbols used in these figures corresponding to those of FIG. 1.

Figure 6:
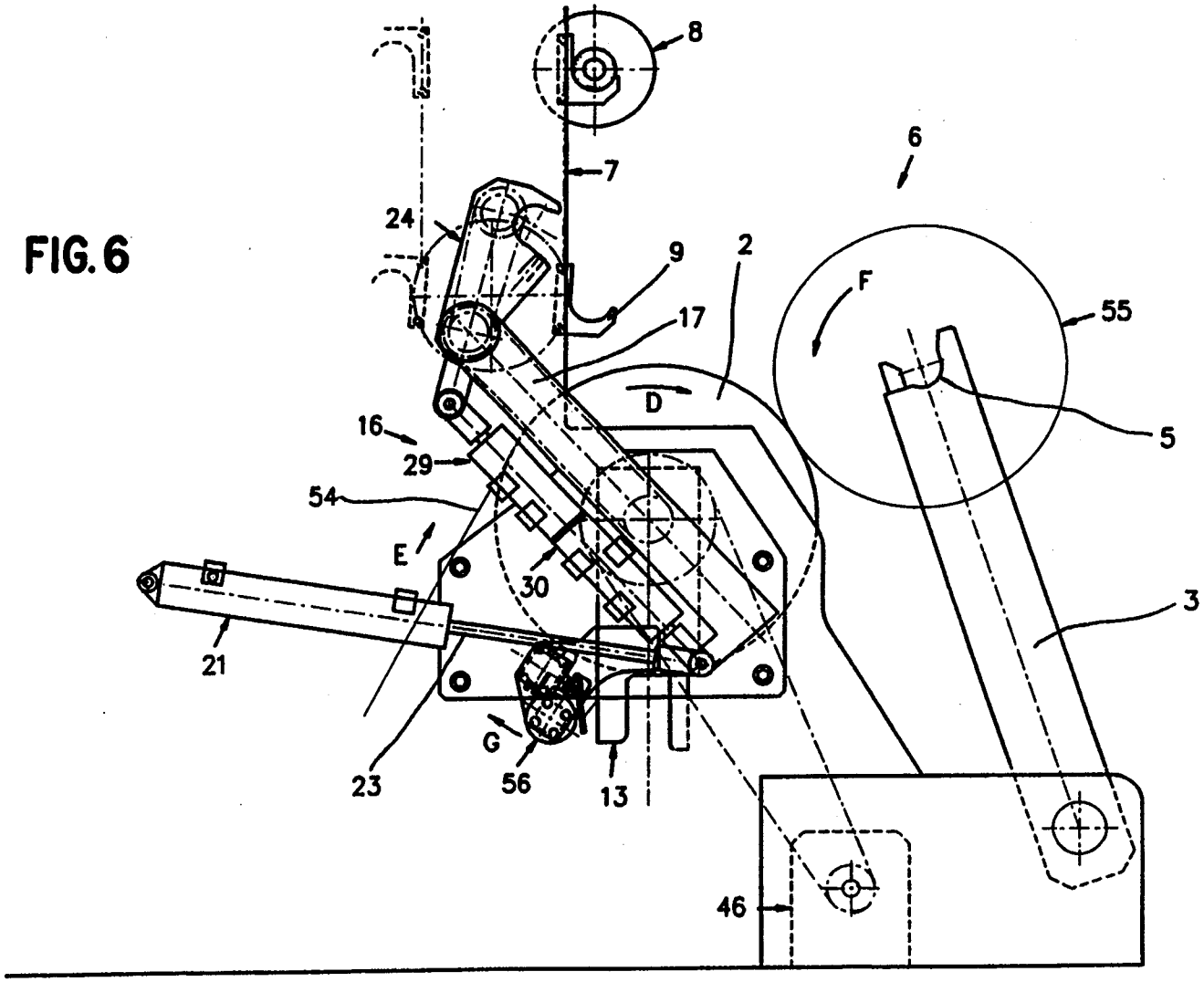
FIGS. 6–12 show the winding apparatus at various points in time of the winding operation in a side view corresponding to FIG. 1.

FIG. 6 shows the drive mechanism 16 in its basic position, which it usually assumes during the rotation of a roll at the main winding location 6. In this Figure, the web of material (for example a sheet of plastic), which is fed continuously in direction E and runs over the winding drum 2, is denoted by 54 and the roll forming in the main winding location 6 is denoted by 55. The winding up of the web of material 54 to form the roll 55, rotating in the direction of the arrow F, takes place in a way known per se with or without driving of the winding shaft mounted in the bearings 5 of the bearing arms 3. In the following description, it is assumed that the winding shaft mounted in the bearing arms 3 is driven by means of a drive (not shown), such as is known per se from the already previously mentioned U.S. Pat. No. 4,191,341.

In this basic position of the drive mechanism 16, the piston rod 23 of the drive 21 is fully extended. The swivel arm 17 is located in its rear end position. The piston rods 28 and 31 of the piston-cylinder units 29, 30 are, by contrast, fully retracted, which means that the coupling arm 24 is held in its rearward end position. The drive motor 46 is switched off. The pivot arms 13 are likewise located in their basic position (6 o'clock position). In FIG. 6 (and also in the following FIGS. 7–12), a separating device 56 for the web of material is also shown, the device being connected to the pivot arm 13 and also being of a known type of design.

Figure 7:
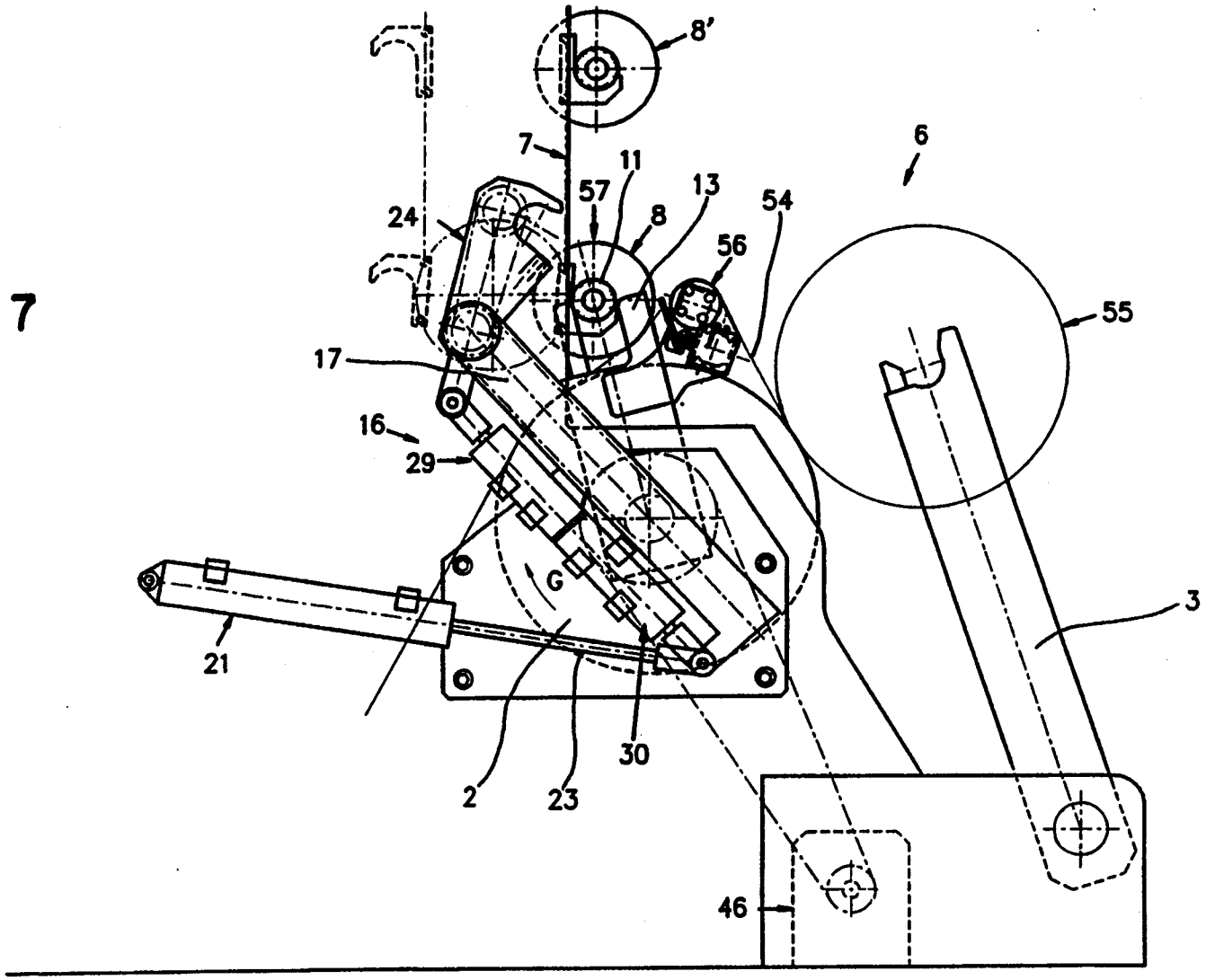

In FIG. 7, a point in time shortly before the completion of the roll 55 is shown. The feed 7 has been briefly set in motion and has lowered the winding core 8 out of the position shown in FIG. 6 into the waiting position 57. In this waiting position 57, the winding core 8 is still not in contact with the web of material 54 running over the winding roller 2. The winding shaft 11 is aligned with the receiving opening 14 of the pivot arms 13, which have in the meantime been pivoted out of their basic position in the direction of the arrow G into the take-over position shown in FIG. 7. The parts of the drive mechanism 16 still assume their basic position described with reference to FIG. 6. As FIG. 7 further shows, the web of material 54 then runs over the separating device 56.

Figure 8:
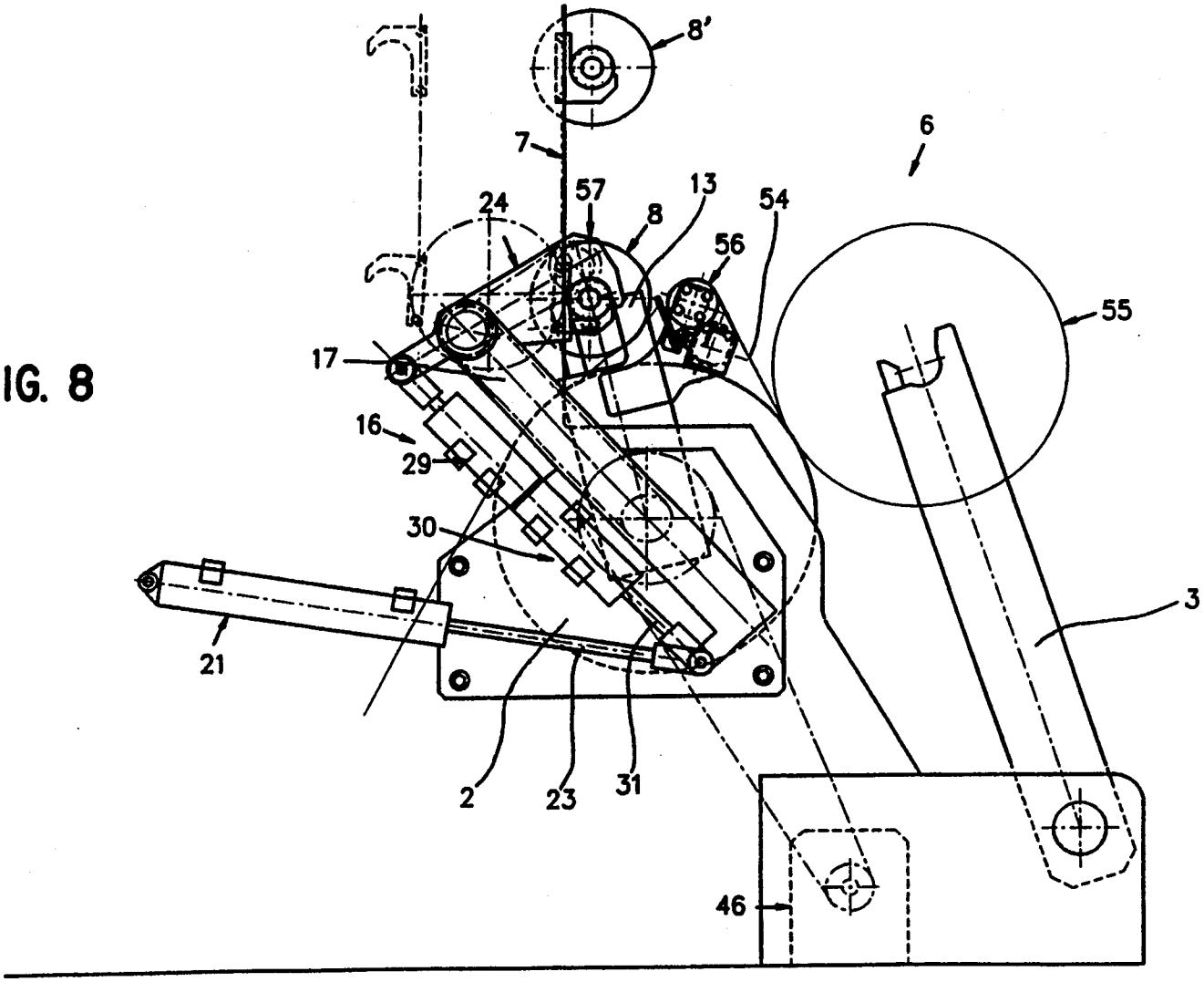
Figure 9:
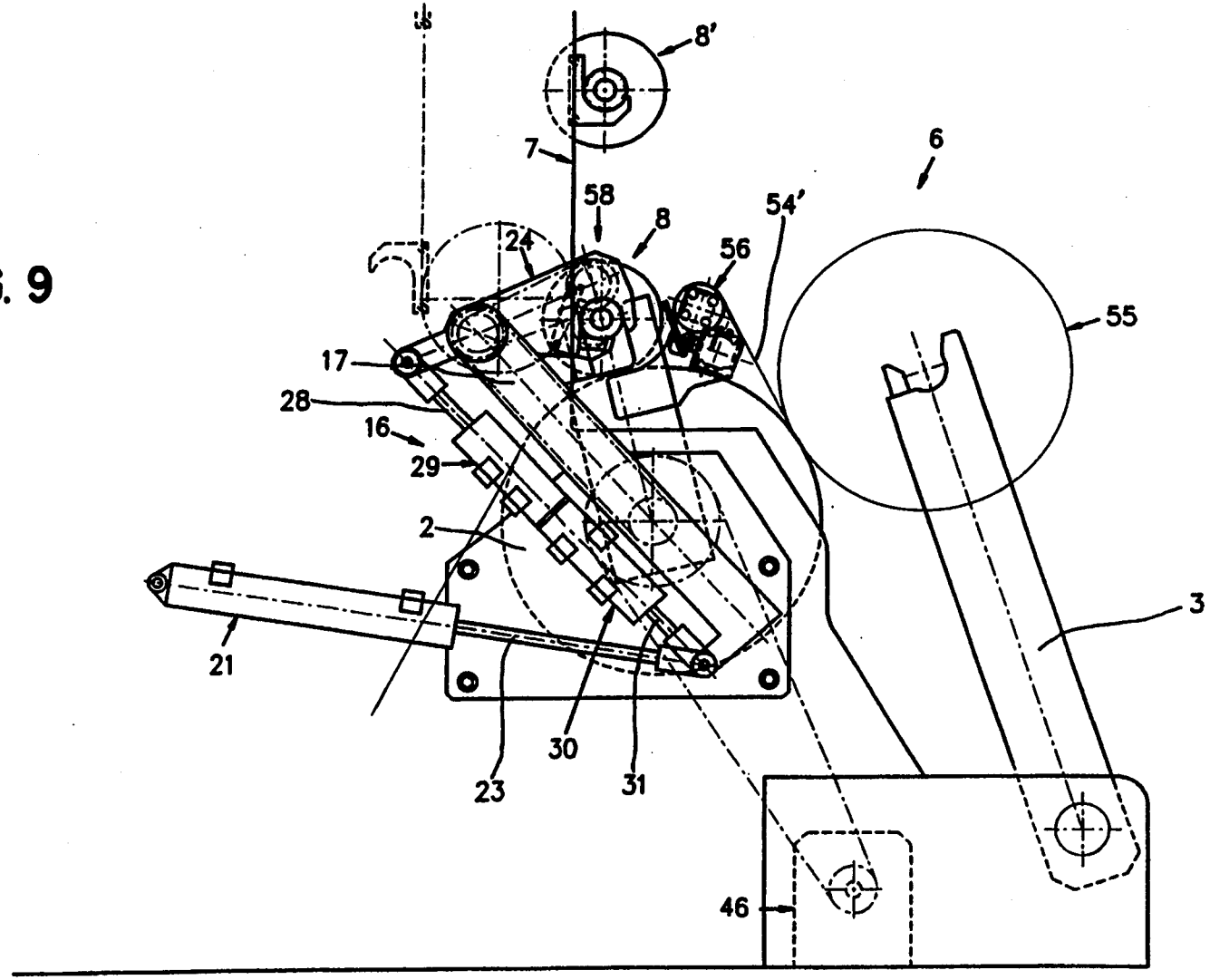

Then, as shown in FIG. 8, the drive mechanism 16 is coupled to the winding core 8, located in waiting position 57. For this purpose, the piston-cylinder unit 30 is activated and its piston rod 31 is extended. The coupling arm 24 is swivelled clockwise into the effective position, in which the gearwheel 34 comes into engagement with the gearwheel 35 on the winding shaft 11 and the countersurface 52 of the holding part 47 comes to rest on the outer ring of the ball bearing or roller bearing 51 on the winding shaft 11. Then, the piston-cylinder unit 50 is activated and the clamping bolt 48 is extended, as is shown in FIGS. 3–5. The winding shaft 11 of the winding core 8, located in winding position 57, is then securely coupled to the drive mechanism. The drive motor 46 is switched on and the winding shaft 11, and consequently the winding core 8, is driven counterclockwise, to be precisely at a circumferential speed corresponding to the speed of movement of the web of material 54. Consequently, the winding core 8 is brought to a synchronous speed before it is set down on the winding roller 2.

After the coupling of the coupling arm 24 onto the winding shaft 11, the piston-cylinder units 21, 29 and 30 are depressurized, i.e. the piston rods 23, 28 and 31 can join in the movements of the swivel arm 17 and of the coupling arm 24 virtually without any resistance.

Then the driven winding core 8 is lowered out of the waiting position 57 and brought into contact with the web of material 54 running over the winding drum 2. This lowering of the driven winding core takes place on the one hand under the effect of gravity and on the other hand by means of the feed 7 (FIG. 9), set in motion once again. Immediately before setting the winding core 8 down on the web of material 54, the latter is severed by means of the separating device 56. The end 54' of the web of material 54, which is lying behind the separating device 56 when viewed in the direction of movement of the web of material 54, is also wound up onto the roll 55, whereas a following part is wound up onto the still driven winding core 8 at an auxiliary winding location, denoted in FIG. 9 by 58.

Figure 10:
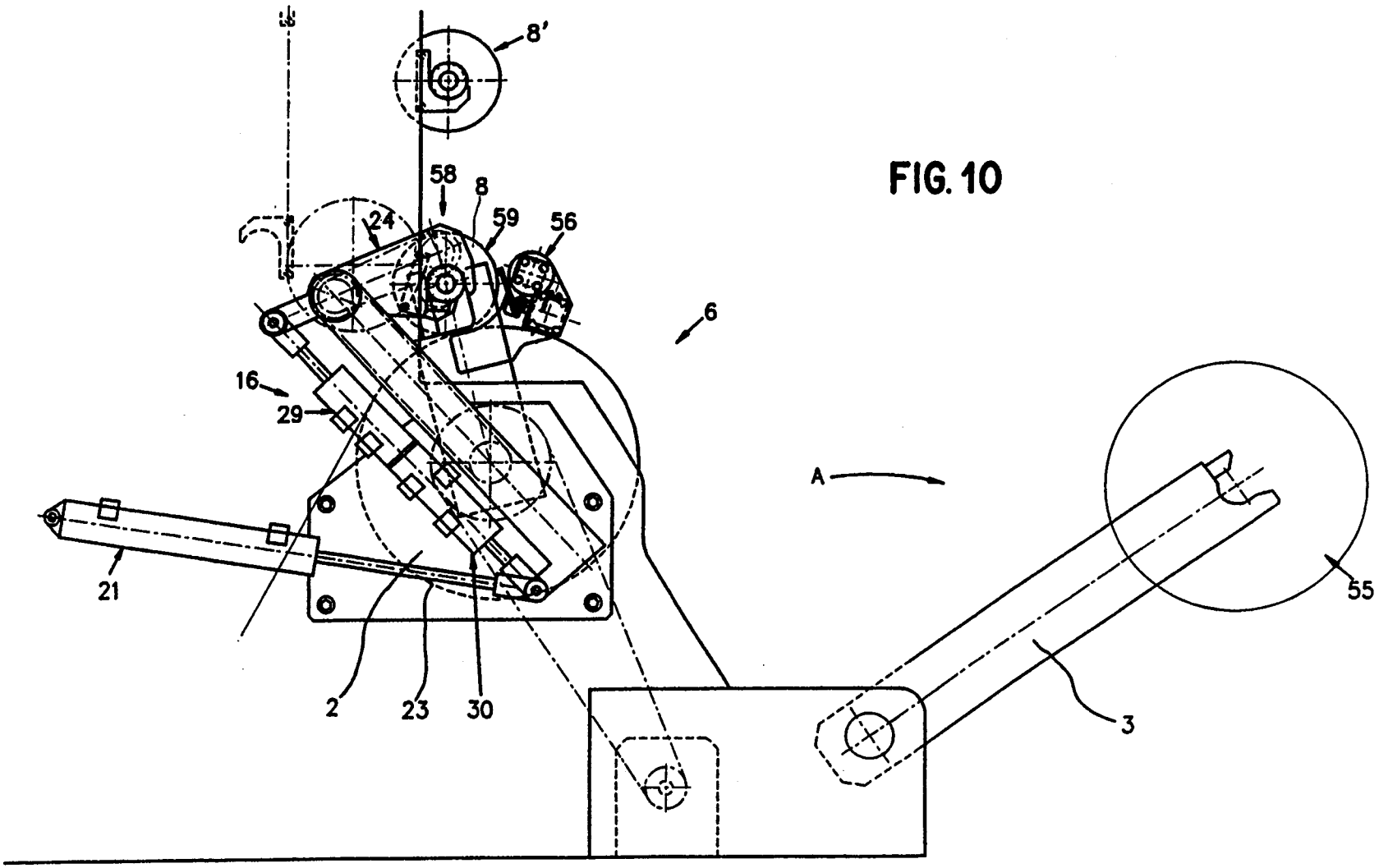

Subsequently, the bearing arms 3 with the finished roll 55 are swivelled away from the main winding location 6 in the direction of the arrow A, as is shown in FIG. 10. The finished roll 55 is then removed from the bearing arms 3 and taken away. Subsequently, the bearing arms 3 are swivelled back again into the winding position. In the meantime, a new roll 59 is formed in the auxiliary winding location 58 on winding core 8.

Figure 11:
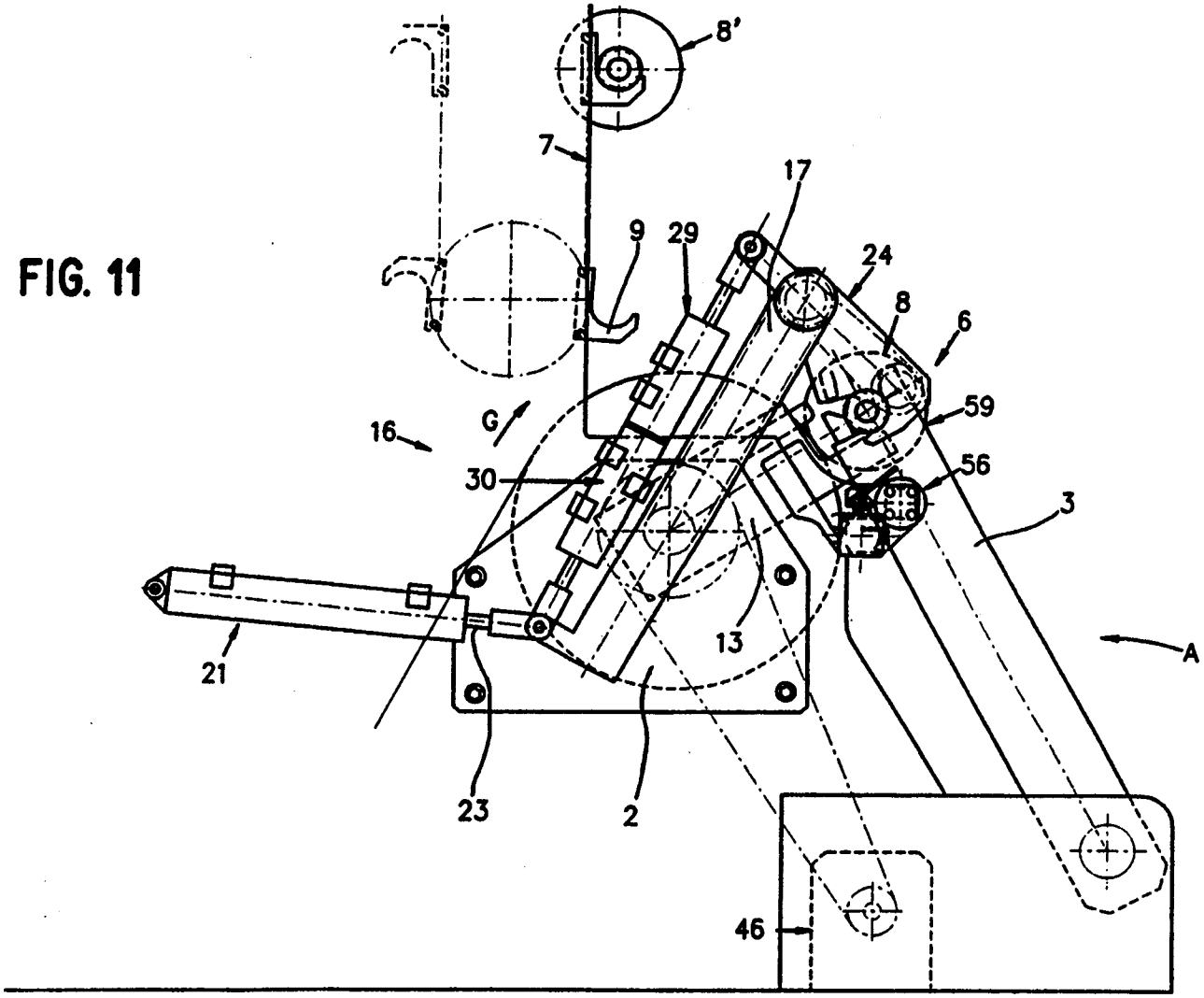
Figure 12:
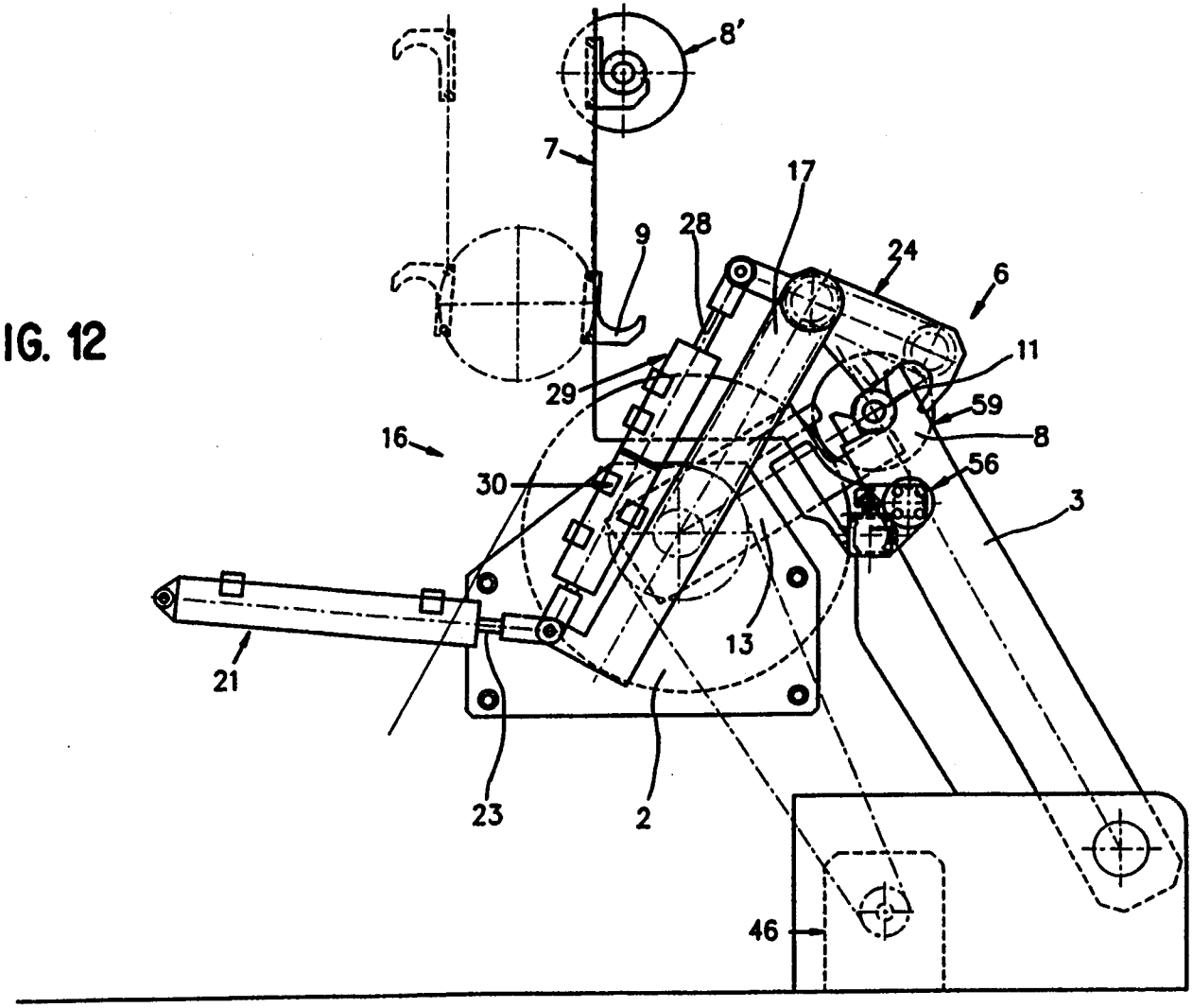

Now the pivot arms 13 are pivoted out of a take-over position in the direction of the arrow G (clockwise), the winding core 8 or the new roll 59 being moved out of the auxiliary winding location 58 to the main winding location 6 (FIG. 11). During this swivelling movement, the winding core 8 is still driven. Since, as mentioned, the piston-cylinder unit 21 is pressureless, the swivel arm 17 can join in the swivelling movement. The coupling arm 24 is likewise free to swivel in a way corresponding to the growing diameter of the new roll 59. Once the pivot arms 13 have reached the transfer position shown in FIG. 11, the transfer of the winding core 8 or of the new roll 59 from the pivot arms 13 onto the bearing arms 3 takes place. Once transfer of the winding core 8 onto the bearing arms 3 has taken place, the drive, assigned to the bearing arms 3 for the winding shaft 11, is set in operation and the drive mechanism 16 is uncoupled (FIG. 12). The latter is performed by withdrawing the clamping bolt 48 into the retracted position and swivelling up the coupling arm 24 by means of the activated cylinder-piston unit 30.

The pivot arms 13 are again pivoted into their basic position (FIG. 6). Likewise, by activating the piston-cylinder unit 21, the swivel arm 17 is swivelled back into the basic position.

At the main winding location 6, the next roll 59 is then wound into its finished form, as already mentioned. Shortly before the roll 59 has reached its specified size, the next change of rolls is initiated and carried out, as explained above with reference to FIGS. 7–12.

Due to the fact that, in a change of rolls, the empty winding core 8 is driven before setting down on the web of material 54 running over the winding drum 2, and remains driven during the entire phase of the change of rolls, it is possible to obtain rolls of very high quality even in the case of materials which can be wound up only with difficulties.

A number of variants of the exemplary embodiment shown are also briefly described below.

Pneumatic units are preferably used for the piston-cylinder units 21, 29 and 30, having an advantage over solutions with other pressure media that the transfer of the winding cores 8 to the pivot arms 13 and from the latter to the bearing arms 3 can take place independent of the tension in the web of material 54.

Instead of the two interconnected piston-cylinder units 29, 30, a single piston-cylinder unit may also be used. This, however, necessitates a more complex control, because the piston has to be held not only in the end positions but also in intermediate positions.

The coupling of the coupling arm 24 onto the winding shaft 11 in the radial direction has the advantage that a better adaptation to the diameter of the roll 59 forming on the winding core 8 is possible and that no axial forces occur. It is, however, also conceivable to couple the drive mechanism 16 onto the winding shaft 11 in the axial direction, for which purpose corresponding coupling parts are to be provided both on the end face of the winding shaft 11 and on the drive mechanism 16.

The design of the drive mechanism 16 described with reference to FIGS. 3–5 makes it possible to design the latter as a separate structural unit, which can also be built-on subsequent to already existing winding apparatus. Due to the described power transmission from the drive motor 46 to the gearwheel 34 by means of a belt drive, the drive motor 46 can be arranged stationary on the basic frame 1.

The winding apparatus described may also be used for winding up webs of material, i.e. webs of plastic sheeting, on which no pressure should be exerted. In the case of such webs of material, the winding up at the main winding location 6 onto the roll 55 takes place as known per se in such a way that a nip always exists between the roll 55 and the winding drum 2 (so-called nip rolling). In such a case, the driven winding core 8 is lowered out of the waiting position 57 only so far that a nip exists between winding core 8 and the web of material 54 running over the winding drum 2. During the movement of the winding core 8 from the auxiliary winding location 58 to the main winding location 6, i.e. during the pivoting of the pivot arms 13 from the take-over position into the transfer position, a nip is then maintained. The web of material 54 is consequently never pressed against the winding drum 2 even during the change of rolls.

While the invention has been described in connection with preferred embodiments, it should be clearly understood that these embodiments are illustrative and not limiting. Many alternatives, modifications and equivalents will be apparent to those skilled in the art. Various changes can be made without departing from the spirit and scope of the invention as defined in the appended claims.

What is claimed is:

1. A process for winding up a continuously fed web of material onto a number of winding cores, comprising the steps of:

a) passing a web of material over a rotatably mounted winding drum at a predetermined speed for winding up at a main winding location onto winding cores along a web path to form rolls of a specified size;

b) coupling a coupling element of a coupling arrangement provided on a swivel arm onto an empty core before a first roll forming at the main winding location reaches its specified size, and driving said coupling element from a stationary drive motor through a transmission such that the winding core is driven at a circumferential speed corresponding to the predetermined speed of the web of material;

c) moving the driven empty winding core to an auxiliary winding location arranged along the web path before the main winding location, and bringing the driven empty core into contact with the web of material, running over the winding drum, at this auxiliary winding location;

d) severing the web of material between the auxiliary winding location and the main winding location and, winding a free end of the web onto the driven winding core at the auxiliary winding location forming a second roll, while the severed first roll is removed from the main winding location; and e) subsequently, moving the winding core from the auxiliary winding location to the main winding location and winding the second roll into finished form.

2. Apparatus for winding up a continuously fed web of material onto a number of winding cores, comprising:

a) a rotatably mounted winding drum, over which a web of material is passed along a web path;

b) a bearing arrangement for receiving and releasably bearing a winding core, onto which the web of material is wound up at a main winding location to form a first roll of a specified size;

c) a feed device for feeding an empty winding core from a waiting position to an auxiliary winding location arranged upstream of the main winding location along the web path, and in which the empty winding core is positionable into contact with the web of material running over the winding drum;

d) a separating device, arranged between the auxiliary winding location and the main winding location, for separating the web of material; and e) a drive mechanism, switchable between on and off states, for rotatably driving the winding core, the mechanism being coupled onto the empty winding core when the core is located in the waiting position, said drive mechanism having the following features:

a swivel arm rotatably mounted in a stationary bearing element;

a coupling arrangement arranged at one end of the swivel arm for coupling with the winding core, the arrangement having a driveable first coupling element releasably positionable into engagement with a second coupling element on the winding core;

a drive arrangement for swivelling the swivel arm; and drive means for driving the first coupling element including a stationary drive motor and a transmission arrangement driven by the drive motor and connected to the first coupling element.

3. Apparatus according to claim 2, wherein the coupling arrangement is mounted on the swivel arm in such a way that it can be swivelled by means of a drive arrangement, including at least one piston-cylinder unit, arranged on the swivel arm from a position of rest into a drive position, the first coupling element being in engagement with the second coupling element on the winding core when in the drive position.

4. Apparatus according to claim 2, wherein both the first and second coupling elements are gearwheels.

5. Apparatus according to claim 2, wherein the coupling arrangement has a clamping arrangement by means of which an outer race of a bearing, seated on a shaft of the winding core, can be securely clamped when the first and second coupling elements are in engagement with each other.

6. Apparatus according to claim 2, wherein the bearing arrangement has two swivelable bearing arms for receiving the winding cores.

7. Apparatus according to claim 2, wherein a second bearing arrangement has two pivot arms for receiving empty winding cores, arranged on opposing sides of the winding drum such that they can swivel about the axis of rotation of the winding drum.

8. Apparatus according to claim 2, wherein the empty winding core is set down on the web of material resting on the winding drum when at the auxiliary winding location.

9. Apparatus according to claim 2, wherein at the auxiliary winding location and during movement from the auxiliary winding location to the main winding location, the empty winding core is held at a distance from the web of material resting on the winding drum.

10. A drive mechanism, designed as a structural unit, for a winding core for use in an apparatus according to claim 2, comprising:

a) a swivel arm rotatably mounted in a bearing element fastened on a frame of the winding apparatus in such a way that a pivot axis of the swivel arm aligns with an axis of rotation of the winding drum;

b) a coupling arrangement arranged at one end of the swivel arm for coupling the winding core, the arrangement having a driveable first coupling element releaseably positionable into engagement with a second coupling element on the winding core; and c) a drive arrangement for the swivelling of the swivel arm.

11. A drive mechanism according to claim 10, wherein the drive arrangement includes a piston-cylinder unit.

12. A drive mechanism according to claim 10, wherein the first and second coupling elements are gear wheels.

13. Apparatus according to claim 2, wherein the bearing arrangement is a first bearing arrangement and a second bearing arrangement is provided for receiving and rotatably mounting the empty winding core fed by the feed device, the second bearing arrangement being positionable between a take-over position and a transfer position, the transfer position allowing transfer of the winding core to the first bearing arrangement.

14. Apparatus according to claim 13, wherein the drive mechanism is uncoupled from the winding core after transfer of the winding core from the second bearing arrangement to the first bearing arrangement.

* * * * *